US008834998B2

(12) United States Patent
Teter

(10) Patent No.: US 8,834,998 B2
(45) Date of Patent: Sep. 16, 2014

(54) VARIABLE STIFFNESS TOW CABLE

(75) Inventor: Joseph P. Teter, Darnestown, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1106 days.

(21) Appl. No.: 12/830,471

(22) Filed: Jul. 6, 2010

(65) Prior Publication Data

US 2012/0006246 A1 Jan. 12, 2012

(51) Int. Cl.
*D02G 3/00* (2006.01)
*B63B 21/56* (2006.01)

(52) U.S. Cl.
CPC ..... *B63B 21/56* (2013.01)
USPC ..... 428/372; 428/375; 428/379; 428/378; 427/230

(58) Field of Classification Search
None
See application file for complete search history.

(56) References Cited

U.S. PATENT DOCUMENTS 3,686,855 A * 8/1972 Falcy et al. ..... 57/220
3,696,325 A * 10/1972 Tallman ..... 367/3
3,895,595 A * 7/1975 Kelly et al. ..... 114/243
4,323,026 A * 4/1982 Gallagher ..... 114/219
5,062,085 A * 10/1991 Andrews, Jr. ..... 367/20
5,212,755 A * 5/1993 Holmberg ..... 385/107
5,235,928 A 8/1993 Shank, Jr.
5,463,193 A * 10/1995 Carpenter et al. ..... 181/207
6,147,931 A 11/2000 Seaman et al.
6,370,084 B1 4/2002 Cray
6,494,158 B1 12/2002 Ruffa
6,561,739 B1 5/2003 Garala
6,997,603 B2 2/2006 Ruffa et al.
8,499,908 B2 * 8/2013 Barker et al. ..... 188/381
2012/0006246 A1 * 1/2012 Teter ..... 114/253

OTHER PUBLICATIONS

Boat Crew Seamanship Manual, Chapter 17 Towing, United States Coast Guard., Sep. 2003.

* cited by examiner

*Primary Examiner* — Jill Gray
(74) *Attorney, Agent, or Firm* — Richard A. Morgan

(57) ABSTRACT

A variable stiffness tow cable comprising a plurality of strands. Most of the strands comprise a polymer with interstitial spaces filled with a ferrofluid comprising nanoparticles. And, least one of the strands is a nanoparticle control field source. The stiffness is varied for a number of control objectives such to dampen motion. In another application, strum is controlled by electrical input rather than by changing the length of tow cable let out.

12 Claims, 2 Drawing Sheets

VARIABLE STIFFNESS TOW CABLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The invention relates to ships. More particularly, the invention relates to towing by means of cable. Most particularly, the invention relates to a tow cable.

2. Description of the Related Art

Marine towing includes diverse operations including recovering boats in distress, moving barges and barge trains, moving and positioning petroleum drilling platforms, transporting and positioning buoys, pulling hydrophone and other instrument assemblies, mine sweeping, underwater towing and recovery and the like. Included in vessel towing are the various operations involved in moving and also in holding a stable position, i.e. resisting motion. The dynamics of towing is different in ocean, lake and river environments and changes with weather conditions. This causes the demands of safe towing to change from towing preparations to final mooring.

In addition to the general transport of the towed vessel, towing requires compensation for static forces, dynamic forces and shock-load forces. Static forces are inertia and moment of inertia, encountered during turning which cause a towed vessel to resist motion.

Dynamic forces occur when the towed vessel is moving. These forces are caused by the towing vessel, and the effects of waves and wind. These forces are based on towed vessel characteristics, including shape, displacement, arrangement and rigging. Friction forces vary with hull shape. Greater wetted surface area causes greater frictional resistance. Hull appendages such as propellers, shafts, skegs, keel and rudders contribute to wetted surface area and frictional resistance. Frictional resistance is managed with towing speed. Higher towing speed causes higher friction resistance and more strain on the tow rigging. Form drag plays a large role in the ability to control changes in the towed vessel's movement. Different hull shapes react to motion through the water in different ways. The shape and size of the towed vessel's hull can either help or hinder effort to move in a straight line, when changing heading, and motion changes in response to waves due to buoyancy. The less water a hull shape has to push out of its way, the easier it will move through the water. A deep draft full-hulled vessel takes more effort to move than one with a fine, hallow hull. A large amount of lateral resistance, spread evenly over the length of the hull, hinders the effort to change a towed vessel's direction. A towed vessel may be able to help offset form drag by using its rudder. A surface wave forms at the bow while the hull moves through the water. Size of the bow wave increases as vessel speed increases, causing the wave to resist the bow moving through the water.

Shock load is rapid, extreme increase in tension on the tow cable, which transfers through the tow rig and fittings to both vessels. The frictional forces of wave drag, spray drag and wind drag act on the hull, topsides, and superstructure and rigging. They all have a major effect on the motion of the towed vessel, and the transfer of forces to and through the towing rig. These constantly changing forces vary with the towed vessel's motion relative to the environmental elements and are directly related to the towed vessel's exposure to them. These forces can add up and cause shock-loading. Wind and wave drag also cause a distressed drifting vessel to make leeway, that is, motion in a downwind direction.

A towed vessel is rarely under the influence of only one force. Usually a combination of forces is experienced, making the tow more complex. Some individual forces are very large and relatively constant. These are relatively easier to handle provided that all towing force changes are gradual. When forces change in an irregular manner, tension on the tow rig varies. Shock-loading may cause severe damage to both towing and towed vessel and overload a tow rig to the point of tow cable or bridle failure. Shock-loading can cause momentary loss of directional control by either vessel and has the potential of capsize small vessels.

Even in calm winds and seas, a towing vessel can encounter a large amount of frictional resistance from form and wave drag when towing a large fishing vessel with trawl lines and net still in the water. The tow rig and vessel fittings can be under heavy strain and the tow vessel engine loads rather high. If the net catches on an obstacle, this new load acts through the tow rig and can suddenly increase stress to a potentially damaging amount. This shock-load can part the tow cable or destroy fittings.

A longer tow cable reduces the effect of shock-loading in two ways. The weight of the line causes a dip in the line, known as a catenary. The longer the cable the greater the possible catenary. When tension increases, energy from shock-loading is dissipated by reducing catenary before it is transferred through the rest of the rig and fittings. A second benefit of a longer tow cable is additional cable length from stretching. Depending on the type of tow cable, lengthening the cable by 50 feet gives 5 to 20 feet more stretch length. This stretching absorbs shock-load. Lengthening the tow cable can be used to keep the two vessels in step and to reduce shock-load.

The effect of shock-loading can be mitigated by tacking to either side of the actual desired course rather than setting a course directly into or directly down heavy seas. This is accomplished by keeping the seas 30° to 45° either side of dead ahead or dead astern. A drogue can be attached to the towed vessel to help prevent it from accelerating down the face of a wave. A drogue adds form drag, but may reduce shock-loading. Shock-loading can capsize or swamp the towed vessel. The additional towing force from a shock-loaded tow cable may cause a smaller vessel to climb its bow wave and become unstable or it may pull the bow through a cresting wave.

In heavy seas, towing vessel speed can be adjusted to match that of the towed vessel. This requires constant observation of the towed vessel and changing speed to compensate for the approaching or receding seas on the towed vessel. One serious danger is cable snap-back. This can occur when the tow cable is stretched to breaking. Some nylon cordage can stretch up to 40% of its length before parting.

Another condition encountered during towing is a persistent induced vibration in the tow cable referred to as strum. This vibration is transmitted into a towed instrument array and can cause damage to instrument components. The vibration can be reduced by changing the length of tow cable so that the cable length is not a harmonic multiple of the vibration. Strum is more fully described in U.S. Pat. No. 6,494,158 to A. A. Ruffa for a Method For Reducing Strum In Tow Cable, incorporated herein by reference.

There is a need in the art of marine towing for an improvement that helps to avoid or reduce inherent dangers. Risk and associated insurance rates may be reduced with an improved tow cable.

SUMMARY OF THE INVENTION

A variable stiffness tow cable comprises a plurality of strands. At least one of the strands comprises a polymer coated along its length with a ferrofluid comprising nanoparticles. At least one of the strands is an electrostatic or electrodynamic field inducing, nanoparticle control field source.

BRIEF DESCRIPTION OF THE DRAWINGS

A more complete appreciation of the invention and many of its attendant advantages will be readily appreciated as the same becomes better understood by reference to the following detailed description when considered in connection with the accompanying drawing wherein.

DETAILED DESCRIPTION OF THE INVENTION

Figure 1:
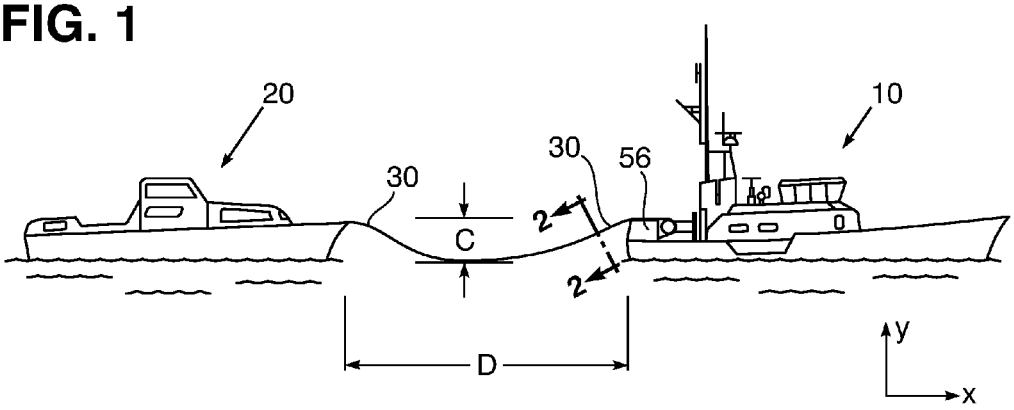
FIG. 1 is a side elevated view of a tow cable connecting two vessels.

The invention is described with reference to the drawing wherein numerals in the written description correspond to like-numbered elements in the several figures. The drawing discloses a preferred embodiment of the invention and is not intended to limit the generally broad scope of the invention as set forth in the claims.

Reference is made to FIG. 1 showing a tow cable 30 attaching the stern of a towing vessel 10 to the bow of a towed vessel 20. Orthogonal axes are labeled x and y. Towing is underway in the x direction. Voltage source and regulator 56 is carried on towing vessel 10 and electrically attached to and in control communication with tow cable 30. Stiffness in tow cable 30 or to sections of tow cable 30 is varied, controlled and set with voltage source and regulator 56 as will be described herein.

The distance D between towing vessel 10 and towed vessel is less than the fully extended length of the tow cable 30. This allows for a dip of length C referred to as catenary. The catenary can be influenced by the tow cable of the invention to provide a more steady state tow. This provides damping of shock-loadings transported through the tow cable towing equipment and to the vessel attached at the other end of the cable.

Although only tow cable 30 is shown, it is understood that towing equipment includes pendants and bridles, deck fittings, hardware for attaching the tow cable, fenders, buoys, drogues and alongside lines.

Tow cables are usually double braided nylon, two to four inches in circumference. Length ordinarily ranges up to 900 feet for vessel towing and can be about 16,400 feet for towed sonar arrays. Nylon is the generic name for long-chain polymeric amide molecules in which recurring amide groups are part of the main polymer chain. Nylon is used for the tow cable because it has a good combination of elongation and elasticity. Other polymers are also used in tow cables.

In more demanding service tow cables must withstand cuts, chafing flattening, over-heating, over-stretching, snagging and hardening. Cables having enhanced physical properties are made of higher strength, flexible materials. These materials include various commercially available synthetic fibrous materials. Such synthetic fibers include aramid polymers, polyaramid polymers and polyethylene polymers. Preferred super-fiber materials include ultra high molecular weight polyethylene. These are sold under the trademarks DEEMA® and SPECTRA®.

Figure 2:
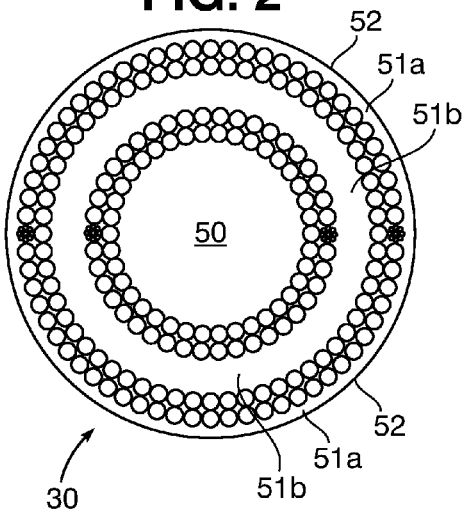
FIG. 2 is a sectional view of the tow cable in FIG. 1 taken along line 2-2.
Figure 2A:
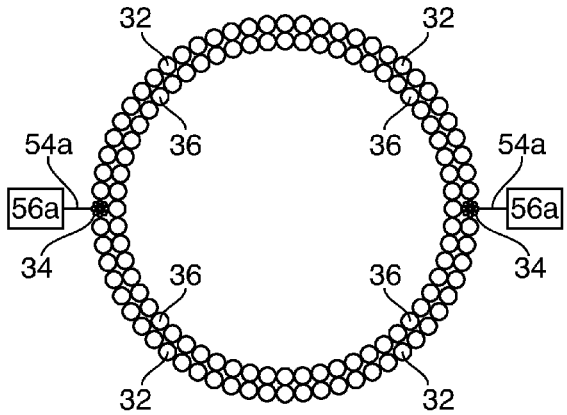
FIG. 2A is a partial rendering of the view of FIG. 2.
Figure 2B:
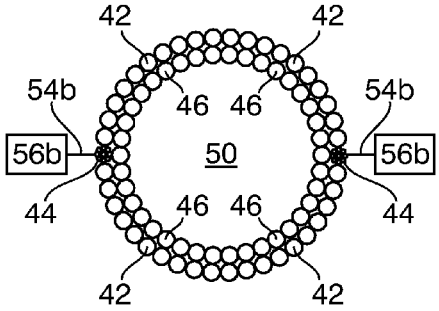
FIG. 2B is another partial rendering of the view of FIG. 2.

FIG. 2 is a sectional view of tow cable 30 taken along line 2-2 in FIG. 1. Tow cable 30 comprises two double braided strand layers. Shown in FIG. 2A is the outer double braided layer of strands. The outer strand layer comprises a multiplicity of strands, some of which are labeled strand 32 and strand 36. The multiplicity of strands is braided together to form the outer strand layer. Shown in FIG. 2B is a multiplicity of inner strands some of which are labeled strand 42 and strand 46. These strands are braided together to form an inner strand layer. The inner strand layer is braided to leave a core 50 at the center of the tow cable cross-section. In this drawing core 50 is void; however when the cable is stretched, the inner and outer strand layers collapse on the core into the void. During stretching, strands rub against each other causing friction resulting in vibrations which may be noticed as strum. An outer sheath 52 made of tough, water impermeable, oil and chemical resistant polymer covers the cable. Sheath 52 is circumferentially and longitudinally continuous along around and along the cable.

A majority of the strands 32, strands 36, strands 42 and strands 46 are made of polymer. The interstitial spaces between the strands are filled with a ferrofluid so that the surface of the polymer strands is coated. The coating is applied in fluid medium, referred to as a ferrofluid. Sheath 52 prevents loss of the particle containing ferrofluid and retention of the fluid in the interstitial space 51*a* under sheath 52, interstitial between strands (not shown), interstitial space 51*c* between the inner and outer layer and space in core 50. The cable is made by injecting ferrofluid into the core and interstitial spaces.

Associated with the strands made of polymer are control strands indicated by strand 34 and strand 44. These are braided into the two double braided strand layers, preferably in a helical pattern relative to the length of the cable 30 to provide a circumferential field. Control strands provide an electrostatic or electrodynamic field to activate the particles. The electrostatic field is provided by an electric control coil. The electrostatic control coil is a series of variable induction coils along the length of the strand. Each of the control coils is addressable via a multiplicity of wire connections 54*a* to the outer ring and a multiplicity of wire connection 54*b* to the inner ring. Wire connections 54*a* and wire connections 54*b* are electrically connected to voltage source and regulator 56*a* for the outer ring and voltage source and regulator 56*b* for the inner ring. The multiplicity of voltage source and regulators 56*a*, 56*b* are assembled in voltage source and regulator 56 on towing vessel 10 shown in FIG. 1. This permits control of all regulators along the cable from the towing vessel 10. Likewise, the electrostatic field is provided by a controllable inductor or controllable capacitor. The inductors or capacitors extend in series along the tow cable and are independently addressable. The electrodynamic field is provided by a magnetic control coil, typically a series of magnetic control coils. This allows for a section of a cable to be stiffened or for different stiffness in different sections of the cable. This may be accomplished with microprocessor addressable switches.

Figure 3:
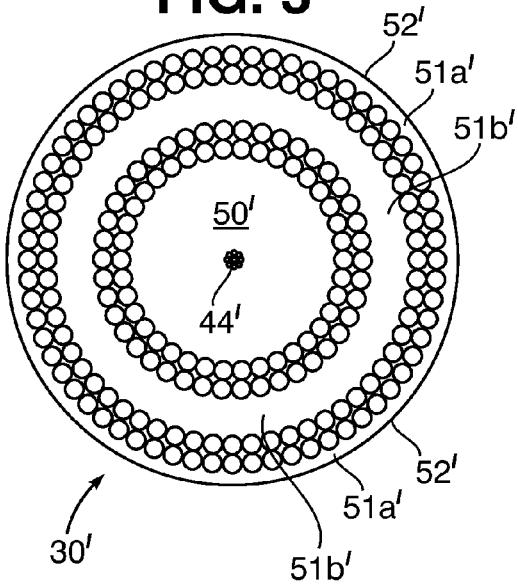
FIG. 3 is an alternate arrangement of the sectional view of the tow cable in FIG. 2.
Figure 3A:
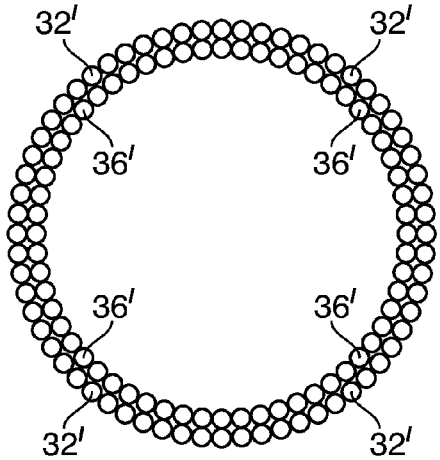
FIG. 3A is a partial rendering of the view of FIG. 3.
Figure 3B:
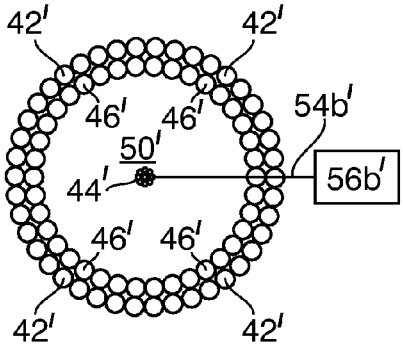
FIG. 3B is another partial rendering of the view of FIG. 3.

FIG. 3 is an alternate configuration for the sectional view of tow cable 30'. Tow cable 30' comprises two double braided strand layers. A multiplicity of outer strands, indicated by strand 32' and strand 36' are braided together to form an outer layer. A multiplicity of inner strands, indicated by strand 42' and strand 46' are braided together to form an inner layer. The strand layers are braided with a core 50' at the center of the tow cable cross-section. In this drawing control strand 44' is located in the core 50' of tow cable 30'. An outer sheath 52' made of tough, water impermeable, oil and chemical resistant polymer covers the cable. Sheath 52' is circumferentially and longitudinally continuous around and along the cable.

Strands 32', strands 36', strands 42' and strands 46' are made of polymer wetted in the interstitial spaces along their length with a ferrofluid. Sheath 52' prevents loss of the particle containing ferrofluid and retention of the fluid in the interstitial space 51*a'* under sheath 52', interstitial space between strands (not shown), interstitial space 51*b'* between the inner and outer layer and space in core 50'.

Control strand 44' provides a controlling circumferential electrostatic or electrodynamic field to stimulate nanoparticles on strands 32', strands 36', strands 42' and strands 46'. The field is provided by a control coil. The control coil is a series of variable induction coils along the length of the strand. Each of the control coils is addressable via wire connections 54*b'* in electrical contact with voltage source and regulator 56*b'*. The voltage range is in the range determined to activate the particles in the range of zero to maximum response. This range is determined by the physical property of the particles used and the size, i.e. resistance, of the tow cable. An electrostatic field is provided by a variable inductor, variable capacitor or addressable switches extending in series along the length of the cable. The inductors are independently addressable. The electrodynamic field is provided by a magnetic control coil, typically a series of magnetic control coils. The control coils are independently addressable.

Ferrofluids are a class of magneto-rheological fluids. The particles in the ferrofluid are those that are stimulated by means of an applied electrostatic or electrodynamic field, that is, particulates having paramagnetic, ferrimagnetic or ferromagnetic properties. Examples of paramagnetic particulates include compounds comprising oxides, chlorides, sulfates, sulfides, hydrates and other organic or inorganic compounds of cerium, chromium, cobalt, dysprosium, erbium, europium, gadolinium, holmium, iron, manganese, neodymium, nickel, praseodymium, samarium, terbium, titanium, uranium, vanadium and yttrium. Paramagnetic elements and alloys include gadolinium, various stainless steels and other alloys of iron, nickel, manganese and cobalt with or without other non-magnetic elements.

Ferromagnetic particulates include magnetite ($Fe_3O_4$) and other compounds of iron and oxygen, and a third metallic component. Ferromagnetic materials include iron, nickel and cobalt, as well as alloys of these and other materials.

Typically, ferrofluids incorporate iron oxides as the magnetic particles. The most suitable iron oxides are ferrites such as γ-ferric oxide. Ferrites and ferric oxides offer a number of physical and chemical properties to the magnetic fluid. These include saturation magnetization, viscosity, magnetic stability and chemical stability of the system. To remain in suspension, the ferrite particles require a surfactant coating, also known as a dispersant, to prevent the particles from coagulating or agglomerating. The surfactants/dispersant has two major functions. The first is to assure a permanent distance between the magnetic particles to overcome the forces of attraction caused by Van der Waal forces and magnetic attraction, i.e. to prevent coagulation or agglomeration. The second is to provide a chemical composition on the outer surface of the magnetic particle that is compatible with the oil-based carrier.

The size of the particles in the ferrofluid can range from, for example, from 10 nanometers to several millimeters, typically 10 nanometers to 100 nanometers. Particle loading in the oil-based carrier is typically 5 vol % to 10 vol %.

The oil-based carrier liquid is generally an organic hydrocarbon oil or silicone oil with molecular weight range up to about eight to nine thousand. Hydrocarbon oils include poly-alpha olefins, aromatic chain structures molecules and esters such as polyol esters.

A preferred ferrofluid comprises titanium coated iron particles in oil. Another preferred ferrofluid comprises high temperature superconducting particles in liquid nitrogen.

Voltage source and controller 56 is a source of alternating current (AC) or direct current (DC) voltage. The applied voltage is in the range determined to activate the particles from zero response to maximum response. This range is determined by the physical property of the particles selected and the resistance of the tow cable materials to the electrostatic or electrodynamic field penetration.

A number of control strategies are possible for adjusting voltage source and controller 56 depending on the operation being carried out and the desired result. It is usually desirable to rely first on the known dynamics of the tow cable. Control by means of the invention is an enhancement to those dynamic characteristics and does not extend the physical limits of the tow cable.

While underway, an electronic range finder is used to measure the distance between the towing vessel and the towed vessel. A dead band is selected for distance between vessels within which no control action is taken. If the distance limit is exceeded, control action is taken to stiffen or relax stiffness in the cable. The result is to vary the catenary to provide more or less pull on the towed vessel.

In another control strategy, oscillations in the distance between the two vessels can be dampened while assuring that a safe amount of catenary is maintained.

In another control strategy, the catenary is stored in a microprocessor and the tow cable controlled to maintain the catenary through a turn or series of turns. This control strategy can be enhanced, if desired, by the inclusion of shape memory alloy strands along with the polymer strands in the cable.

In another strategy, a section of a tow cable is stiffened after it has assumed a desired shape.

In another control strategy, strum in the tow cable is damped by letting out or taking in a less than functionally significant amount of cable to change the resonant frequency of the tow cable.

In another control strategy, simple manual control of the tow cable is replaced with a microprocessor based system with multiple sensor inputs to determine optimum control response to include active motion control, relative motion damping and motion control during loading/offloading. The microprocessor based control system can eliminate the need for drogues to control motion in the towed vessel. In another control strategy, The distance and relative motion between two towed barges is controlled in a multiple barge train. Again, small amounts of stiffening and slackening of the cable control adjusts the position of two unpowered barges relative to each other.

In another control strategy, the cable is used to tie up a ship to a dock. The ship's distance from the dock is continuously monitored and controlled to reduce motion during loading and unloading or to reduce bumping over time. The cable is stiffened as necessary to reduce motion and bumping.

The foregoing discussion discloses and describes embodiments of the invention by way of example. One skilled in the art will readily recognize from this discussion, that various changes, modifications and variations can be made therein without departing from the spirit and scope of the invention as defined in the following claims.

What is claimed is:

1. A variable stiffness tow cable comprising a multiplicity of strands wherein:

(a.) at least one of the multiplicity of stands comprises a polymer strand in contact along its length with a ferrofluid including suspended nanoparticles, and (b.) at least one of the multiplicity of strands is a nanoparticle control field source.

2. The variable stiffness tow cable of claim 1, wherein a majority of the multiplicity of strands comprise polymer strands in contact along their length with a ferrofluid including suspended nanoparticles.

3. The variable stiffness tow cable of claim 1 wherein the multiplicity of strands comprise a polymer.

4. The variable stiffness tow cable of claim 1 wherein the multiplicity of strands comprise nylon.

5. The variable stiffness tow cable of claim 1 wherein the nanoparticle control field source strand is at a tow cable core.

6. The variable stiffness tow cable of claim 1 wherein the nanoparticle control field source strand is interwoven with the polymer strands.

7. The variable stiffness tow cable of claim 1, wherein the nanoparticle control field source comprises at least one magnetic control coil.

8. The variable stiffness tow cable of claim 1 wherein the nanoparticle control field source comprises a series of magnetic control coils.

9. The variable stiffness tow cable of claim 1 wherein the nanoparticle control field source comprises a series of variable capacitors.

10. The variable stiffness tow cable of claim 1 wherein the nanoparticle control field source comprises a series of variable inductors.

11. The variable stiffness tow cable of claim 1 additionally comprising microprocessor controlled addressable switches in control combination with the nanoparticle control field source.

12. A method of controlling stiffness in a cable including a multiplicity of polymer strands, the method comprising the steps of:

(a.) coating the polymer strands with a ferrofluid including suspended nanoparticles, (b.) applying a variable electric control field to the nanoparticles, and (c.) varying voltage to the variable electric control field to achieve a selected stiffness in the cable.

* * * * *